US006783380B1

(12) United States Patent
Kamath et al.

(10) Patent No.: US 6,783,380 B1
(45) Date of Patent: Aug. 31, 2004

(54) LOW INSERTION FORCE CONNECTOR SYSTEM

(75) Inventors: Shashidhar M. Kamath, Canton, MI (US); Bryan D. Cole, Canton, MI (US); David Kwang, Southfield, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/458,820

(22) Filed: Jun. 11, 2003

(51) Int. Cl.[7] ..... H01R 13/64
(52) U.S. Cl. ..... 439/247; 439/310
(58) Field of Search ..... 439/310, 32, 246–8, 439/155, 157

(56) References Cited

U.S. PATENT DOCUMENTS 4,332,432 A 6/1982 Colleran
5,244,400 A 9/1993 Hatagishi
5,252,089 A 10/1993 Hatagishi et al.
5,975,930 A * 11/1999 Matsuura et al. ..... 439/310
6,439,902 B1 8/2002 Cole et al.
6,480,005 B2 * 11/2002 Nagano et al. ..... 439/310
6,579,111 B2 * 6/2003 Fukamachi ..... 439/247

* cited by examiner

*Primary Examiner*—Renee Luebke
(74) *Attorney, Agent, or Firm*—Young & Basile, P.C.

(57) ABSTRACT

An insertion-force reducing connector assembly and method for mating multi-terminal male and female connectors of the type used in automotive wiring harnesses. The female connector is movably retained in a frame-like holder by a self-actuating force reducing link that automatically couples a male connector inserted into the holder to the female connector with an insertion/withdrawal ratio in which the female connector moves away from the male connector in the terminal-mating direction more slowly than the male connector is inserted, thus allowing the connectors to be coupled over a longer than normal terminal-mating distance and reducing the insertion force needed to mate the terminals. The method includes the steps of coupling the female connector to the holder and subsequently mating the male connector to the female connector in the holder.

15 Claims, 7 Drawing Sheets

LOW INSERTION FORCE CONNECTOR SYSTEM

FIELD OF THE INVENTION

The present invention is in the field of multi-terminal male/female electrical connectors of the type commonly used for automotive wiring harness connections, and more specifically to mechanisms used with such connectors to reduce the amount of assembly force needed to fully mate their terminals.

BACKGROUND OF THE INVENTION

Multi-terminal electrical connectors can require a significant amount of "insertion" force to properly mate their respective sets of terminals. Certain applications require large numbers of mating terminals, for example in automotive wire harness connectors where dozens of pin-type terminals may be contained in a single connector set. The more terminals in the connector set, the more force needed to mate the connectors. The higher the insertion force, the more likely it is that terminals will be improperly mated or damaged.

One solution for reducing insertion force has been to provide a mechanical assist structure on one of the connectors, for example an exterior lever for engaging a portion of the other connector once the connectors are initially mated. The lever is manually operated to draw the connectors into a fully mated condition, the lever's mechanical advantage reducing the amount of assembly force needed to do so. The levers are sometimes provided with locking structure to lock the fully mated connectors and their terminals together in a manner preventing unintended separation.

Another solution for reducing insertion force in such connectors has been to provide an actuator member or frame that holds or mounts a first of the connectors while a mating connector is partially inserted in a first terminal-mating direction. After partial connection or insertion, angled cam slots on the actuator member cause or require at least one of the mating connectors to be moved laterally or obliquely in a second direction to draw the connectors into a fully mated condition with a mechanical advantage.

Cam-assist levers are relatively bulky, exposed, and fragile features that usually require additional structure on their supporting connectors to keep them in a pre-lock condition ready to receive mating connectors. Assist levers further require the person mating the connectors to perform two different operations: axial insertion and lever-assist. Frame-type actuator members can also be bulky, add a third piece to the connector set that may require assembly to one of the connectors at the connector mating location, and require a multi-directional insertion sequence that increases the possibility of error by the person mating the connectors.

SUMMARY OF THE INVENTION

The invention is an insertion force reducing structure built into a female connector holder to which the female connector is movably coupled, and activated by the insertion of the male connector to increase the straight-line terminal-mating distance between the connectors, thereby reducing the felt insertion force. The person mating the connectors simply plugs the connectors together in a straight line, while the holder automatically programs the relative axial movement of the connectors to achieve the reduction in insertion force.

In the preferred form, the holder is a frame sized to axially receive the mating portions of the female and male connectors from opposite sides for initial mating engagement within the frame, the connectors then continuing axial movement through the frame over the terminal-mating distance at different rates mechanically programmed by the frame, until fully mated. Self-actuating force-reducing links on the frame are coupled to the female connector to retain the female connector in the frame for axial back and forth movement in the terminal mating direction, and are positioned to automatically receive portions of the male connector when the male connector begins to mate with the female connector. The force-reducing links cause the male and female connectors to be coupled with an insertion/withdrawal ratio of X:Y, where X is the rate of insertion of the male connector and is greater than Y, and Y is the withdrawal rate of the female connector. The female connector accordingly moves backward in the terminal mating direction at a lesser rate than the male connector moves forward, effectively lengthening the terminal mating distance and reducing the insertion force distribution per unit length, thus reducing the actual insertion force needed to couple the connectors.

In a further preferred form, the holder frame fits closely around the female connector, and may even fully enclose it, so that the person assembling the connectors is effectively handling the female connector directly, and so that the overall bulk and operator-perceived complexity of the connector set is reduced. The force-reducing links are flush with or recessed from the outer surface of the holder frame, and can therefore be exposed in a manner allowing a simplified and robust assembly of the female connector to the holder frame via the links, as well as visual confirmation of their engagement with the male connector.

The holder frame includes alignment structure for guiding the male connector into engagement with the force-reducing links. In a preferred form the alignment structure cooperates with the female connector and the links such that the female connector must be in a forward, ready-to-mate position before the male connector can be inserted.

The invention also encompasses a method including the steps for assembling the female connector to the holder frame and the subsequent mating of the assembled female connector/holder assembly to the male connector with a mechanically programmed axial insertion/withdrawal ratio favoring the male connector.

These and other features and advantages of the invention will become apparent upon further reading of the specification in light of the accompanying drawings.

DETAILED DESCRIPTION OF THE INVENTION

Figure 1:
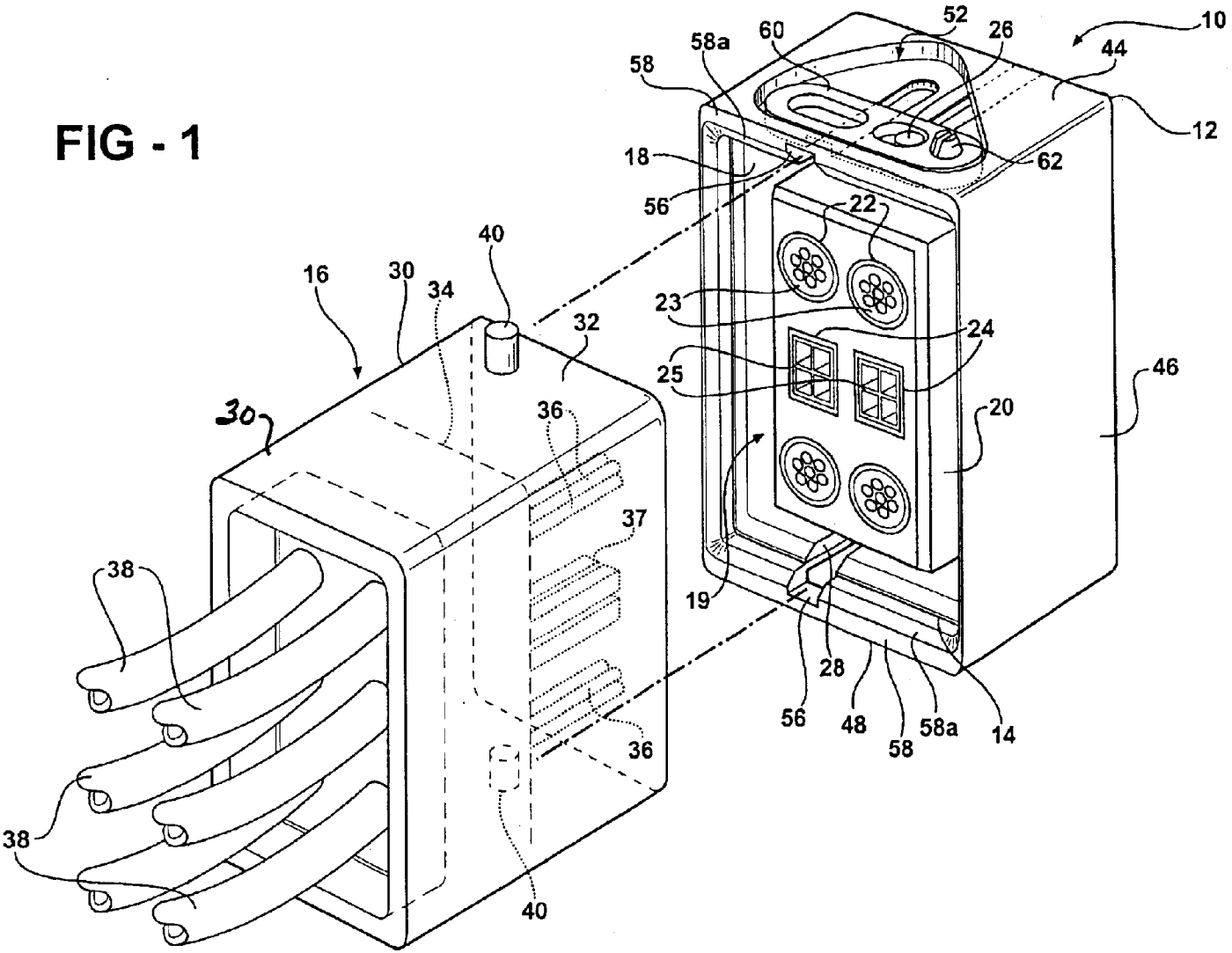
FIG. 1 is a perspective view of a separated connector set according to the invention, looking toward the mating face of the female connector in its holder.
Figure 2:
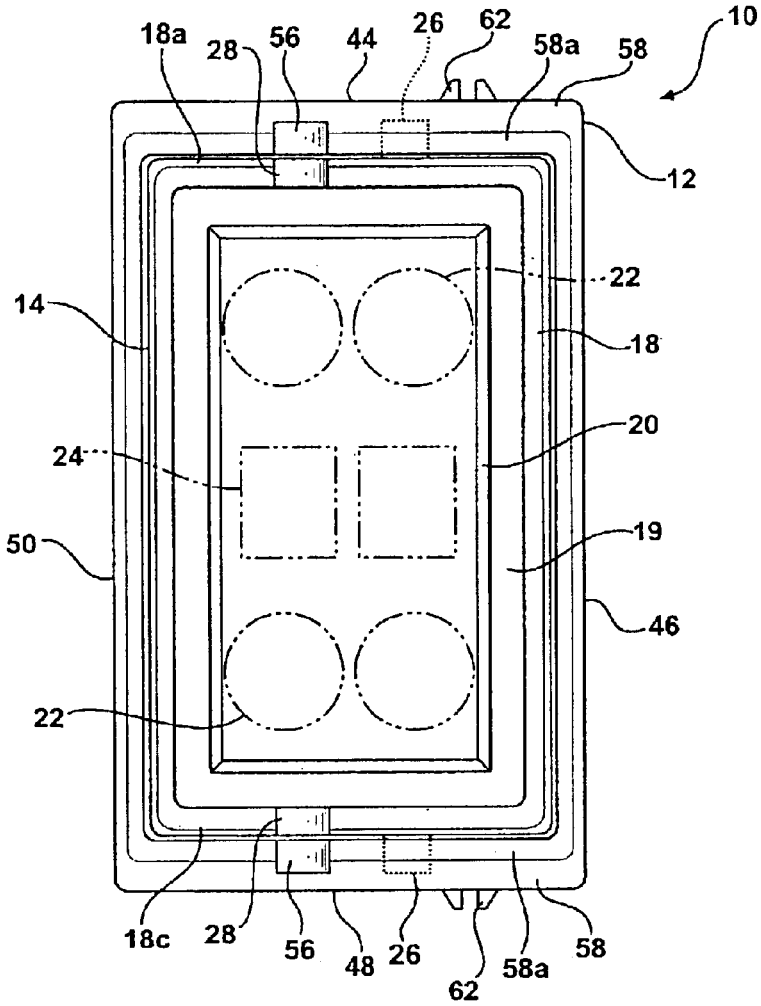
FIG. 2 is a front elevation view of the female connector/holder assembly of FIG. 1.
Figure 3:
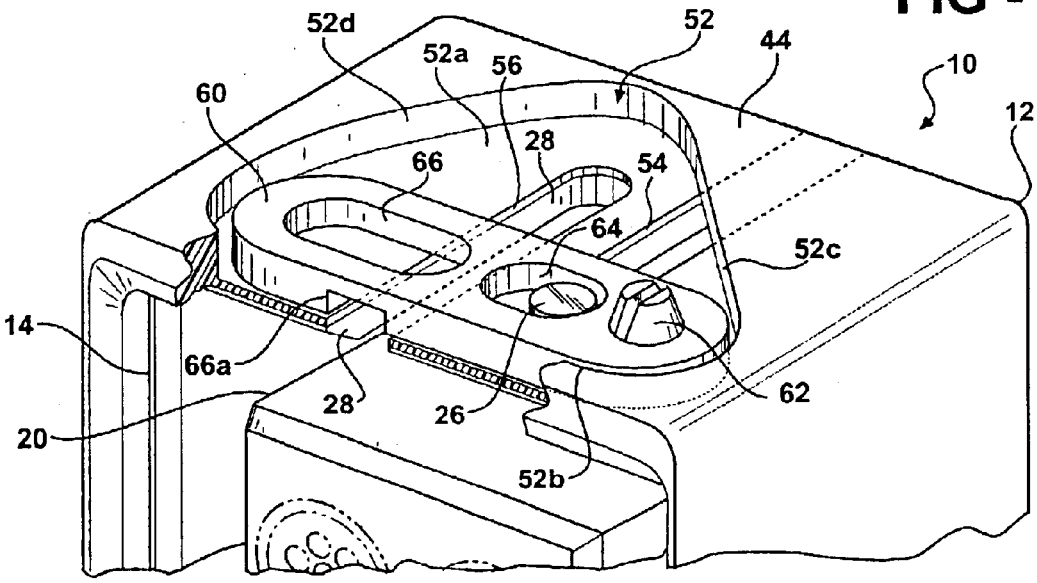
FIG. 3 is a detailed perspective view of the upper surface of the female connector/holder assembly of FIG. 1, with a portion of the front edge of the holder cut away to better show detail of the force reducing link and the male connector alignment
Figure 4:
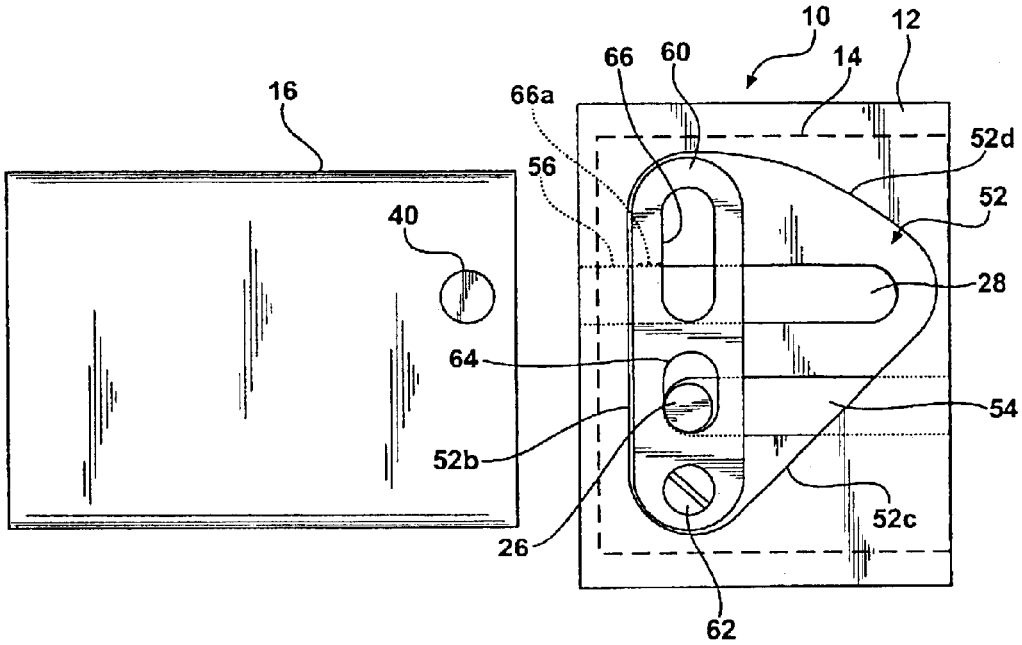
FIG. 4 is an exploded top plan view of the separated male connector and the female connector/holder assembly of FIG. 1 aligned for mating.

Referring to FIG. 1, a connector set using the insertion force reducing structure of the invention has a female connector assembly 10 and a male connector 16. Female connector assembly 10 includes a connector holder 12 mounting a female connector 14 for limited back and forth movement in the connector mating direction. The male connector 16 is designed to be plugged axially into female connector 14 within the confines of holder 12. Female connector 14 is shown at its forward limit of travel in holder 12, at the end facing male connector 16, and in the illustrated embodiment contained completely within the close-fitting holder 12 so that assembly 10 gives the appearance and feel of a single body to the person assembling the connector set.

Referring to FIGS. 1–4 and 8, female connector 14 has an outer body 18, in the illustrated embodiment with a rectangular shape, an inner terminal block 20 having a number of terminal cavities 22, 24 and corresponding terminals 23, 25 of known type, and a gap or space 19 separating the outer body or wall 18 from terminal block 20 to receive a forward shroud portion of male connector 16 over block 20 in known manner. The terms "female" and "male" as applied to connectors 14 and 16 refer to the mating relationship of their bodies and not necessarily to the types of terminal each contains.

Female connector 14 also has upper and lower connector posts or pins 26 for slidably connecting the female connector to female guide slots 54 in the upper and lower walls 44, 48 of holder 12. Open-ended male alignment slots 28 are formed in the upper and lower walls 18*a* and 18*c* of the female connector's outer body 18, opening at the forward or mating edge or face of the female connector to receive connector/guide pins on the male connector. The rear of female connector 14 contains openings (not shown) to receive a number of wires 29 (FIG. 8) into electrical connection with terminals 23, 25 in known manner.

Male connector 16 has a body 30, also rectangular in the illustrated example, with a front shroud portion 32 sized to fit over female terminal block 20 in the space 19 between female terminal block 20 and female outer body 18; a male terminal block 34 containing a number of terminals 36, 37 of known type, corresponding to the terminals in the female connector; terminated wires 38 connected to terminals 36, 37 in known fashion; and, connector guide posts or pins 40 extending from the upper and lower walls of shroud portion 32 for alignment with male guide slots 56 on the female connector holder and with alignment slots 28 on the female connector when the connectors are mated.

In the illustrated example, female connector holder 12 is an open-ended rectangular frame whose walls 44, 46, 48, 50 generally follow the outer contours of female connector 14 for a close sliding fit between them. Upper and lower walls 44 and 48 each have an actuator recess 52 containing a force reducing link in a reasonably protected yet accessible and visible manner. Recess 52 is roughly triangular or wedge-shaped and extends only partway through the frame walls, with a bottom surfaces 52*a*, front edge 52*b*, rear edge 52*c*, and arcuate radial edge 52*d*. Male connector guide slot 56 opens into the front edge 52*b* from the front of holder 12, while female connector guide slot 54 opens into rear edge 52*c* from the rear of holder 12. Both the male and female guide slots extend through the bottom surface 52*a* of recess 52 to slidingly guide the connector pins from the male and female connectors, respectively. The front edge or face 58 of holder 12 is preferably beveled as shown at 58*a* to help guide the male connector 16 and its pins 40 into female connector 14 and slots 28 and 56. Slots 28 and 56 and pins 40 in the illustrated example are offset from the centerline of connector/holder assembly 10 and connector 16 so that the male connector is properly oriented upon insertion.

Each recess 52 contains a self-actuating force-reducing link 60, a pivoting lever arm sized and shaped to lie flat on recess bottom surface 52*a*, rotatably secured at one end with a pivot pin 62 and movable in an arc from an initial engagement position against front edge 52*b* to a fully mated position against rear edge 52*c*, following radius edge 52*d*. Each link 60 has an inner female actuator slot 64, an outer male actuator slot 66, and an axial entry cutout 66*a* for allowing a male connector pin 40 into the male actuator slot 66. Axial entry cutout 66*a* is aligned with the holder's male guide slot 56 and the female connector's alignment slot 28 when link 60 is against forward edge 52*b*.

Figure 5:
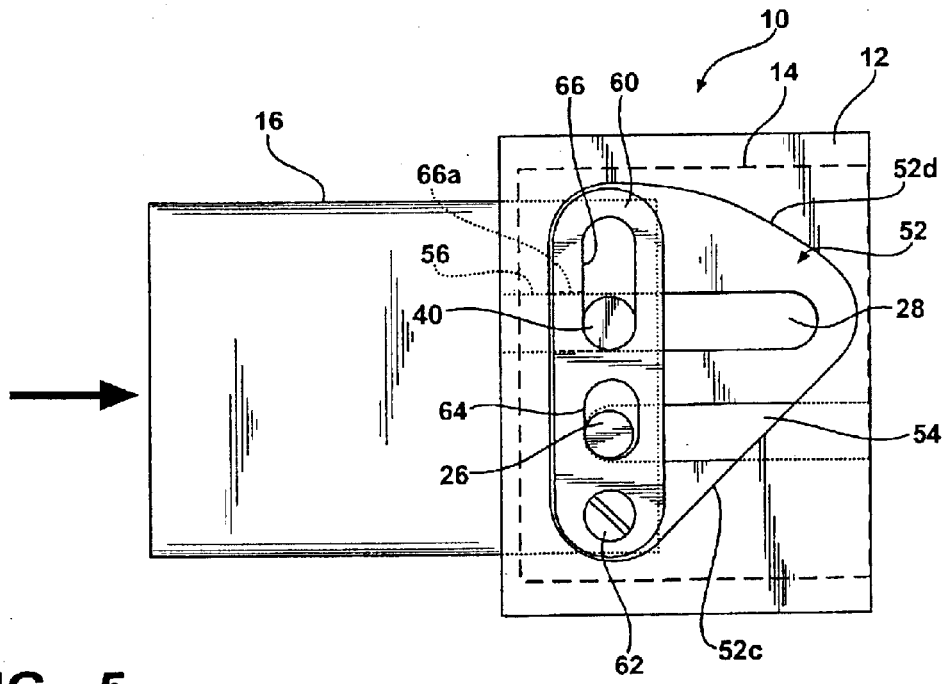
FIG. 5 is a top plan view similar to FIG. 4, with the male connector beginning to mate with the female connector and engaging the force-reducing link on the female connector holder.
Figure 6:
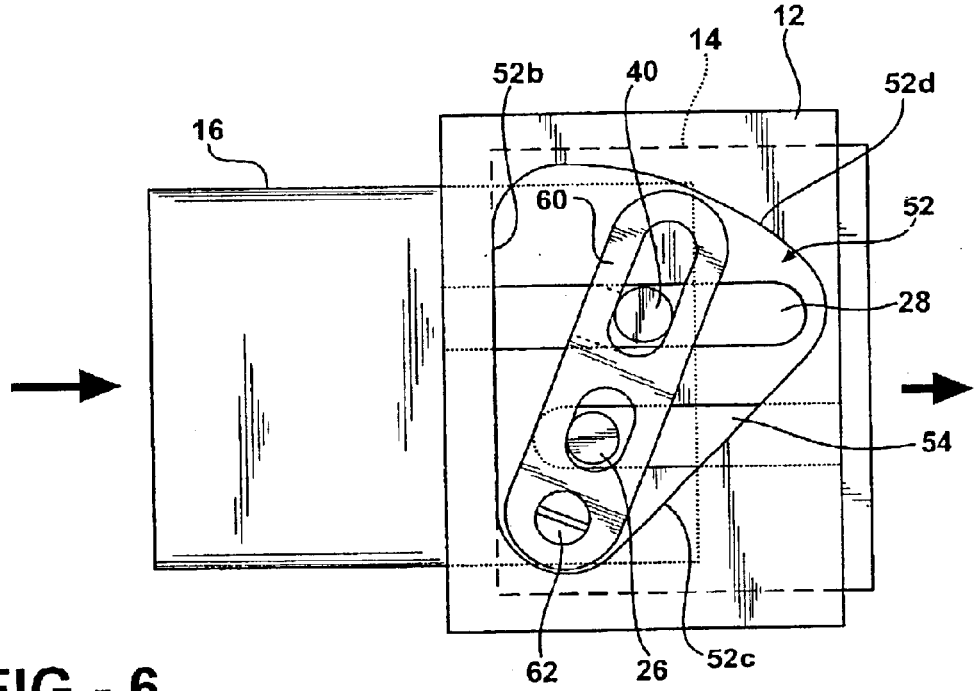
FIG. 6 is similar to FIG. 5, but with the male connector partway mated with the female connector.
Figure 7:
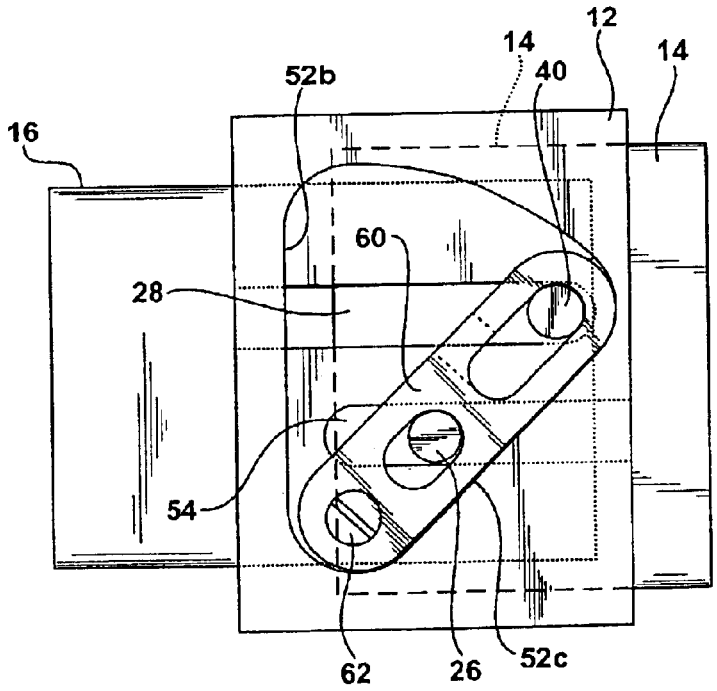
FIG. 7 is similar to FIG. 6, but with the male connector fully mated with the female connector.
Figure 8:
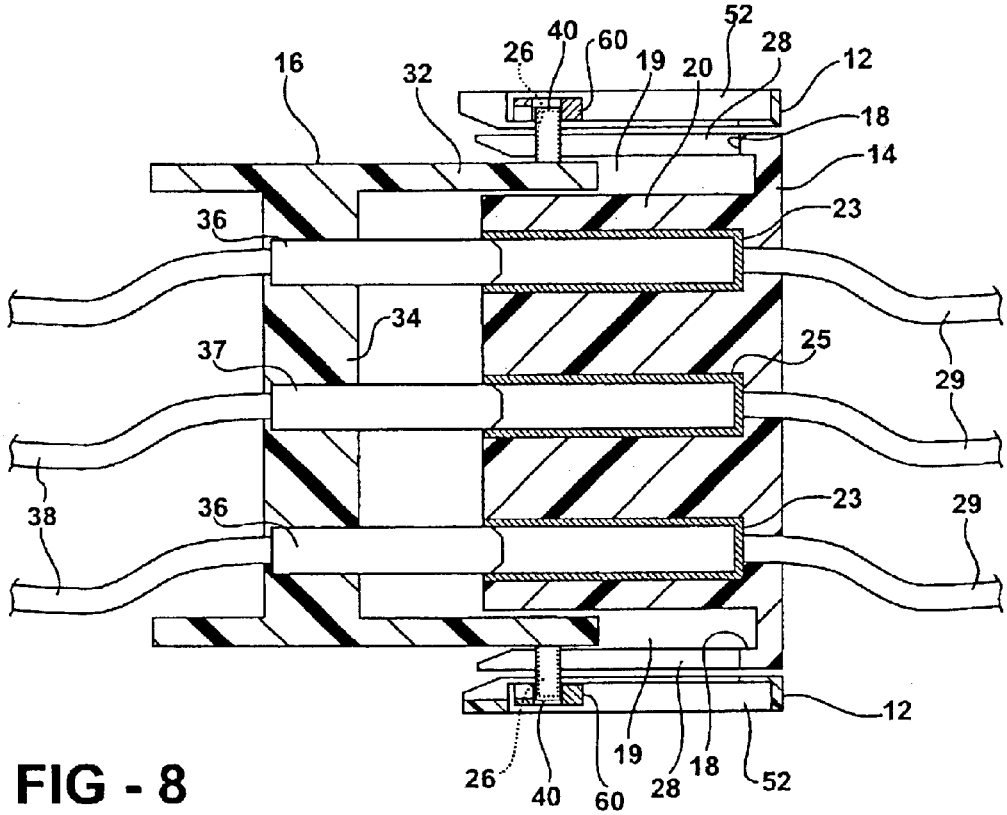
FIG. 8 is a side elevation view of the initial mating engagement of the connector set of FIG. 5, sectioned through the mating terminals of the connectors.

Referring next to the connector mating sequences illustrated in FIGS. 5–7 and 8–10, once pins 40 on male connector 16 are aligned with slots 28, 56 and cutout 66*a*, male connector 16 is pushed axially into initial mating engagement with female connector 14 in holder 12. Male connector pins 40 enter through the aligned slots and cutouts into the inner ends of male actuator slots 66 of links 60, as shown in FIGS. 5 and 8. As male connector 16 is moved further in the terminal-mating direction shown by the arrows in FIGS. 6 and 9, each link 60 is automatically actuated to begin rotating toward the rear of holder 12, thereby actuating female connector 14 through pins 26 trapped in the inner actuator slots 64. The inner actuator slots act as reduced radius cams to move the female connector rearwardly at a predetermined rate less than the forward insertion rate of male connector 16. The relative displacement of the rear edges of male and female female connectors 16 and 14 is illustrated in FIGS. 6 and 7, with connector 14 clearly having moved a lesser distance than the male connector.

Figure 9:
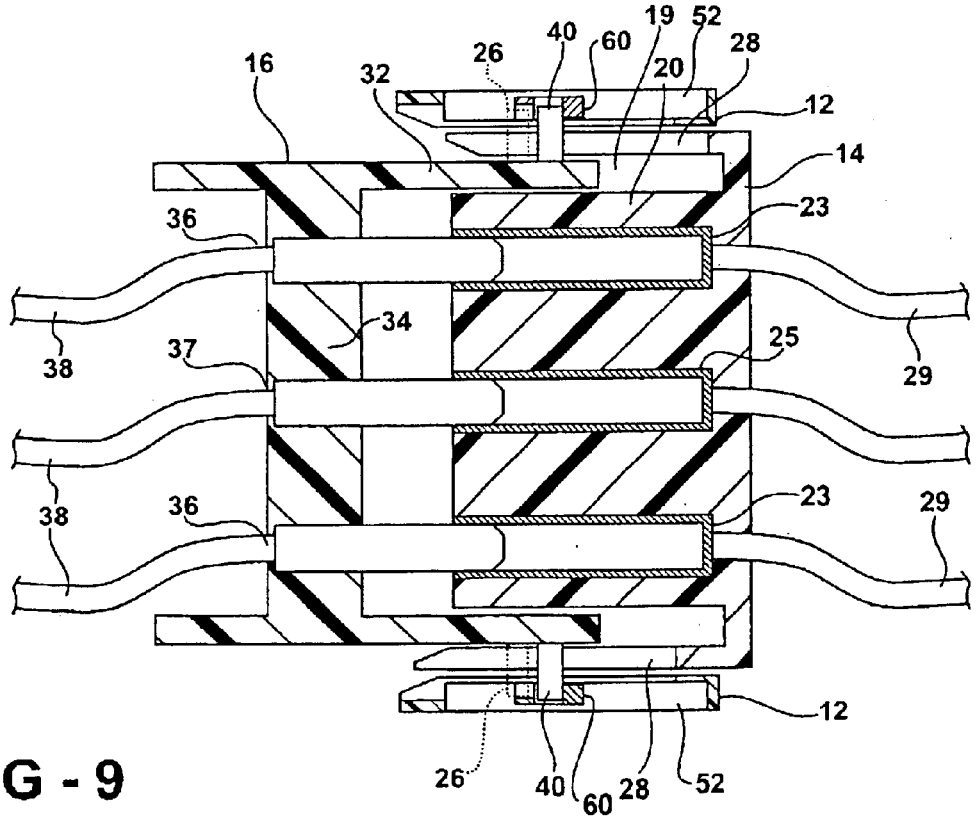
FIG. 9 is a side elevation view of the partway mated connector set of FIG. 6, sectioned through the connector terminals.
Figure 10:
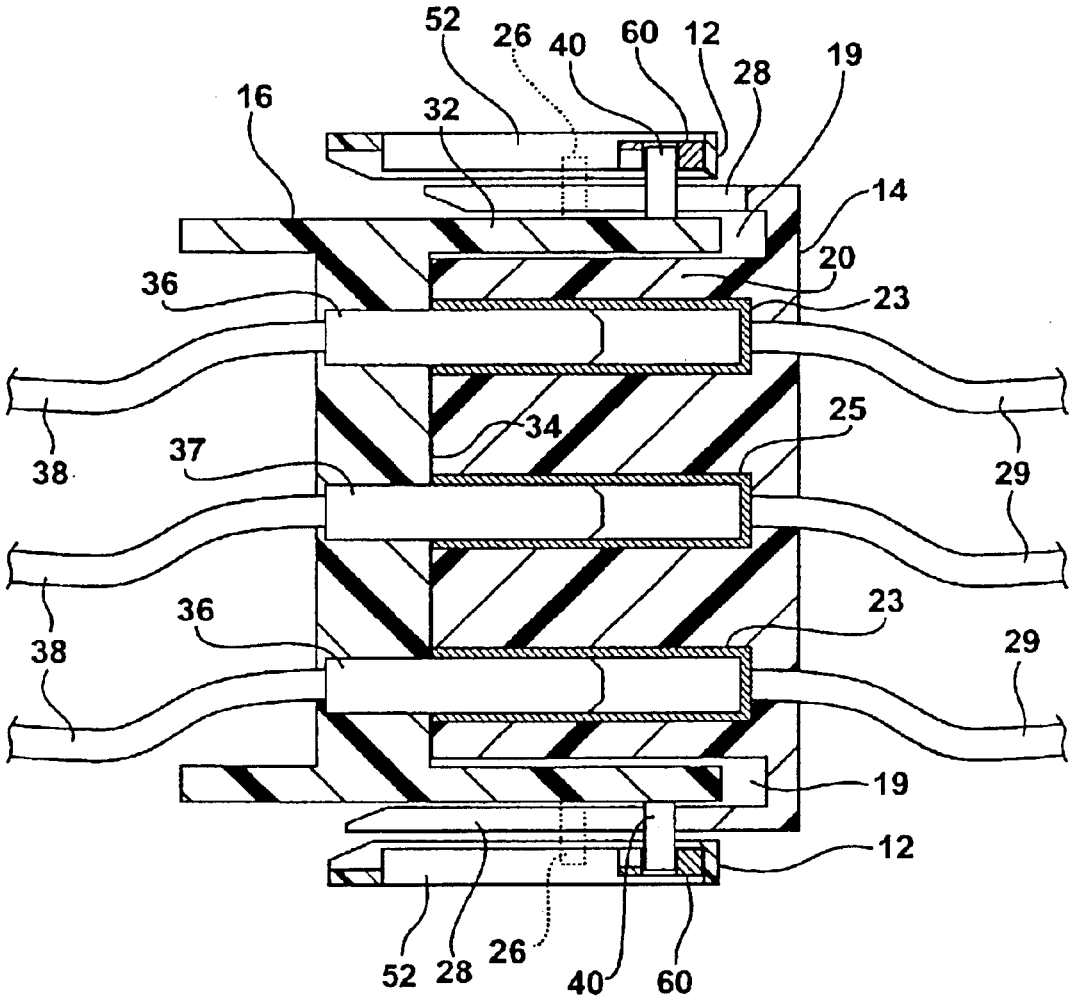
FIG. 10 is a side elevation view of the fully mated connector set of FIG. 7, sectioned through the connector terminals.

FIGS. 7 and 10 show the fully mated condition of the connectors. The motion of links 60 in recesses 52 is timed to coincide with full terminal mating, and the abutment of each link 60 against the rear edge 52*c* of recess 52 signals the end of the connector mating process. The overall distance moved by female connector 14 is some fraction of the distance moved by male connector 16, lengthening the terminal-mating distance but ultimately allowing the male connector to overtake and fully mate with the female connector within the confines of holder 12. This relative insertion/withdrawal ratio X:Y of the terminals in the connectors, where X is the insertion rate of the male connector terminals greater than Y, and Y is the withdrawal rate of the female connector terminals less than X, is best shown in FIGS. 8–10. The lengthening of the overall terminal-mating distance accordingly reduces the overall insertion force for the person assembling the connectors.

It will be understood by those skilled in the art that the insertion/withdrawal ratio, and the resulting insertion force reduction for a given set of connectors and terminals, can be programmed differently in a number of ways, for example by altering the length of links 60 and/or the length of their actuator slots; by altering the geometry of the links and/or actuator slots; and/or by altering the geometry of recesses 52. It will also be understood that while rectangular connector and holder bodies with actuator links in the upper and lower walls is the preferred example, different numbers of actuators at different locations on differently shaped holders are possible (including a single such link on the holder).

Figure 11:
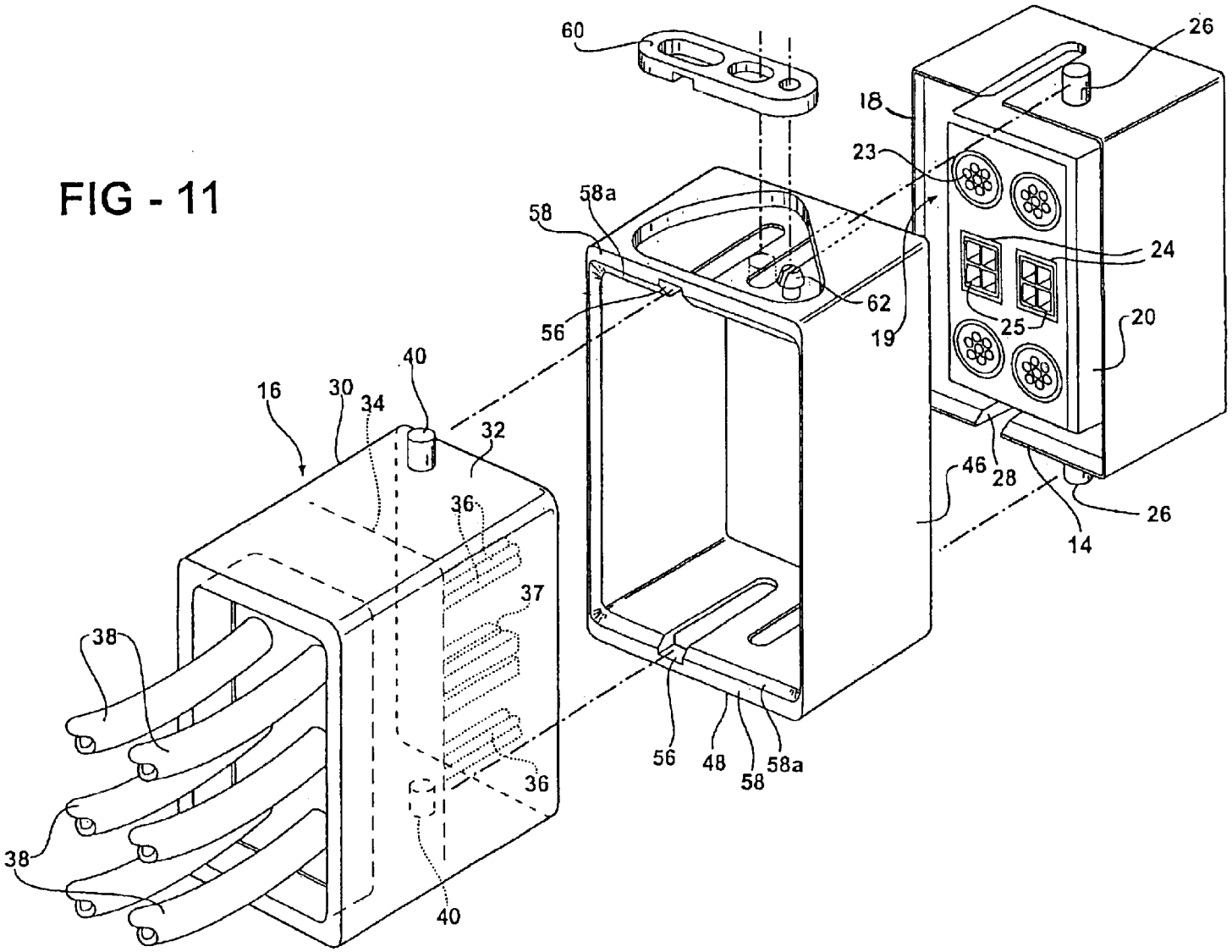
FIG. 11 is an exploded view of the connector set of FIG. 1, illustrating the manner in which the parts are first assembled and then mated.

Referring to FIG. 11, the connector set of FIGS. 1–10 is illustrated in a fully exploded view showing the method of assembling first the female connector 14 to holder 12 to form assembly 10, and the subsequent mating of male connector 16 with assembly 10. First, the female connector 14 is inserted axially into holder 12 from the rear side of the holder, with female connector pins 26 aligned with and sliding through female guide slots 54. Next, actuator links 60 are installed vertically onto pivot pins 62 and female connector pins 26, movably trapping the female connector 14 in holder 12 to form assembly 10. With the female connector/holder 10 assembled, and the female connector and actuator links placed in the forward, ready-to-mate position shown in FIGS. 4 and 5, the male connector is inserted axially a first distance from the forward side into an initial engagement with the actuator links, and then a further distance axially while the male and female connectors are coupled by the actuator links to move in the pre-selected insertion/withdrawal ratio. Axial movement of the male and female connectors is then terminated by the actuator links on the holder at the predetermined point of full terminal mating.

It is possible to provide locking structure of known type, for example latches and tabs or locking fingers, on the bodies of the male connector and the female connector or holder to lock the connectors in the fully mated position. This will be a matter of choice for those skilled in the art, as many such structures are known.

It will be understood that the connector and holder bodies and the actuator links illustrated above will preferably be made from a suitable polymer or polymers in known manner, by way of example nylon or resin type plastics of the type commonly used for wire harness type connectors.

The foregoing illustrated example of the invention is for explanation rather limitation, as modifications such as those listed above and others will be apparent to those skilled in the art now that we have disclosed the invention via this preferred embodiment. The invention is intended to be limited only by the following claims. We accordingly claim:

What is claimed is:

1. An electrical connector set for automotive wire harnesses, having a male connector and a female connector, the female connector being movably retained in a female connector holder for limited axial movement in a terminal-mating direction, the male connector being mateable with the female connector in the terminal-mating direction within the female connector holder, the male connector and female connector having mating terminals capable of being fully mated over a first terminal-mating distance in the terminal-mating direction, the female connector being axially enclosed by the female connector holder when in a forward, ready-to-mate position, the female connector being activated by insertion of the male connector into the female connector within the holder in the terminal-mating direction to move away from the male connector in the terminal-mating direction at a withdrawal rate less than an insertion rate of the male connector, such that the terminals of the male and female connectors are fully mated over a second terminal-mating distance greater than the first terminal-mating distance, thereby reducing insertion force.

2. The connector set of claim 1, wherein the female connector is movably retained in the female connector holder by a self-actuating force reducing link on the female connector holder, the force-reducing link positioned to be engaged by the male connector when the male connector is initially mated with the female connector within the holder.

3. The connector set of claim 2, wherein the male connector engages the force-reducing link prior to an initial engagement of terminals in the male and female connectors.

4. The connector set of claim 2, wherein the self-actuating force reducing link is a pivot arm having an inner end coupled to the female connector and an outer end for receiving and coupling a portion of the male connector through the pivot arm to the female connector.

5. The connector set of claim 4, wherein the inner end of the pivot arm has an elongated inner slot in which a post portion of the female connector is movably trapped for radial movement toward and away from a pivot end of the pivot arm, and the outer end of the pivot arm has an elongated outer slot in which a post portion of the male connector is movably trapped for radial movement toward and away from the pivot end of the pivot arm, the outer slot being longer than the inner slot.

6. The connector set of claim 5, wherein the outer end of the pivot arm includes a guide opening connecting the outer slot with a forward edge of the pivot arm, the guide opening being sized to admit the post portion of the male connector into the outer slot.

7. The connector set of claim 6, wherein the female connector holder has a female guide slot opening from a rear side of the holder and aligned with the inner slot of the pivot arm, and a male guide slot opening from a front side of the holder and aligned with the outer slot of the pivot arm, such that the female connector post portion rides in the female guide slot while movably trapped in the inner slot of the pivot arm, and the male connector post rides in the male guide slot while movably trapped in the outer slot of the pivot arm.

8. The connector set of claim 7, wherein the guide opening in the pivot arm is aligned with the opening of the male guide slot when the female connector and the pivot arm are placed in the forward ready-to-mate position in the holder.

9. The connector set of claim 7, wherein the female connector has a male alignment slot aligned with the male guide slot and opening from a front side of the female connector, and the male connector post rides in the male alignment slot.

10. The connector set of claim 9, wherein the guide and alignment slots are parallel to the terminal-mating direction of the male and female connectors.

11. An electrical connector set for automotive wire harnesses, having a male connector and a female connector, the female connector being movably retained in a female connector holder for limited axial movement in a terminal-mating direction, the male connector being mateable with the female connector in the terminal-mating direction within the female connector holder, the male connector and female connector having mating terminals capable of being fully mated over a first terminal-mating distance in the terminal-mating direction, the female connector being activated by insertion of the male connector into the female connector within the holder in the terminal-mating direction to move away from the male connector in the terminal-mating direction at a withdrawal rate less than an insertion rate of the male connector, such that the terminals of the male and female connectors are fully mated over a second terminal-mating distance greater than the first terminal-mating distance, thereby reducing insertion force, the female connector being movably retained in the female connector holder by a self-actuating force reducing link, the force-reducing link being retained in a recess in an outer surface of the female connector holder, the force reducing link positioned to be engaged by the male connector when the male connector is initially mated with the female connector within the holder.

12. The connector set of claim 11, wherein the recess is open to visual inspection from the exterior of the female connector holder.

13. In a multi-terminal connector set having a male connector and a female connector mateable in an axial terminal-mating direction to electrically mate their respective terminals over a first terminal-mating distance, an insertion-force reducing structure comprising:

a female connector holder in which the female connector is movably coupled for limited axial movement in the terminal-mating direction, and which is responsive to the male connector being inserted in the terminal-mating direction to automatically couple the male connector to the female connector with different rates of axial movement in the terminal-mating direction to lengthen the first terminal-mating distance to a second greater terminal-mating distance, the holder being an open-ended frame sized to axially receive mating portions of the male and female connectors from opposite ends, the holder being sized to axially enclose the female connector when the female connector is in a forwardmost ready-to-mate position within the holder.

14. The connector set of claim 13, wherein the holder includes a movable force-reducing link coupled to the female connector and adapted to receive the male connector when the male connector is inserted to couple the male connector to the female connector for simultaneous movement in the terminal-mating direction before the terminals begin mating.

15. The connector set of claim 14, wherein the force-reducing link couples the male connector to the female connector for movement with an insertion/withdrawal ratio in which the insertion rate of the male connector is greater than the withdrawal rate of the female connector.

* * * * *